US006527511B1

(12) United States Patent
Wu

(10) Patent No.: US 6,527,511 B1
(45) Date of Patent: Mar. 4, 2003

(54) STRUCTURE OF AN ACID/BASE RESISTANCE PUMP

(76) Inventor: Huang-Chang Wu, PO Box 82-144, Taipei (TW)

( * ) Notice: Subject to any disclaimer, the term of this patent is extended or adjusted under 35 U.S.C. 154(b) by 0 days.

(21) Appl. No.: 09/956,223

(22) Filed: Sep. 20, 2001

(51) Int. Cl.[7] ..... F04D 29/54
(52) U.S. Cl. ..... 415/196; 415/214.1
(58) Field of Search ..... 415/196, 197, 415/214.1, 217.1, 200, 189; 417/423.11, 423.14, 424.1

(56) References Cited

U.S. PATENT DOCUMENTS 5,895,203 A * 4/1999 Klein ..... 415/122.1

* cited by examiner

*Primary Examiner*—Edward K. Look
*Assistant Examiner*—Dwayne J. White
(74) *Attorney, Agent, or Firm*—Leong C. Lei

(57) ABSTRACT

An improved structure of an acid/base resistance pump is disclosed. The improved structure of an acid/base resistance pump has a motor, a body housing, a center cavity, an axle device, a blade device and a water-transporting seat, the motor being mounted on the top of the housing and the center of the motor being the axle device for transmission, the front section of the axle device being connected with the motor and the blade device for fluid flowing being disposed at the other end of the center of the axle device, and the lower side of the housing being the water-transporting seat, characterized in that the center body is detachably mounted between the water-transporting seat and the body housing such that the blade device is located at the external side of the center cavity, and the center cavity isolates the solution at the position between the water-transporting seat and the blade device.

1 Claim, 4 Drawing Sheets

STRUCTURE OF AN ACID/BASE RESISTANCE PUMP

BACKGROUND OF THE INVENTION (a) Field of the Invention

The present invention relates to an improved structure of an acid/base resistance pump, and in particular, a pump having a detachable center cavity to isolate corrosive solution when the pump is utilized in withdrawing the corrosive solution.

(b) Description of the Prior Art

FIG. 1 shows an installation view of a conventional pump. As shown in the figure, the conventional vertical pump A is used to pump a solution 81 from an electroplating bath 8, filtering by a filtering device 9, and returning to the electroplating bath 8.

Referring to FIG. 2 and FIG. 2A, the conventional pump comprises a motor 1, a body housing 2, a blade device 3, a water-transporting seat 4, an axle device 5, and an axle cover 6. In this conventional pump structure, if any of the parts is damaged for instance by the corrosive solution, the parts cannot be replaced one by one. The entire pump has to be replaced and the cost of the pump is normally rather high. Further, the area where the corrosive solution contacting with the parts is rather large, in particular, the solution flowing to the blades 41, therefore, the parts of the pump are frequently corroded, which need to be replaced.

Further, the axle cover 6 is fixed to the body housing 2, and if pumps of different power are required by customers to utilize in various types of solution transportation, the parts of a specific type of pumps cannot be used in other types of pumps, instead, new mold to produce these new parts for the pump has to be exploited. In view of the above, the drawbacks of the conventional pumps are that the flexibility of parts changing is not possible and the area of parts contacting with solution is large. Therefore, it is an object of the present invention to provide an improved structure of an acid/base resistance pump, wherein the drawbacks of the conventional pump can be overcome.

SUMMARY OF THE INVENTION

Accordingly, it is object of the present invention to provide an improved structure of an acid/base resistance pump, wherein the contact surface of the pump with the solution is reduced, and the replacement of corroded parts or the upgrading of motor of the pump can be done separately.

An aspect of the present invention is to provide an improved structure of an acid/base resistance pump, having a motor, a body housing, a center cavity, an axle device, a blade device and a water-transporting seat, the motor being mounted on the top of the housing and the center of the motor being the axle device for transmission, the front section of the axle device being connected to the motor and the blade device for solution flowing being disposed at the other end of the center of the axle device, and the lower side of the housing being the water-transporting seat, characterized in that the center body is detachably mounted between the water-transporting seat and the body housing such that the blade device is located at the external side of the center cavity, and the center cavity isolates the solution at the position between the water-transporting seat and the blade device.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
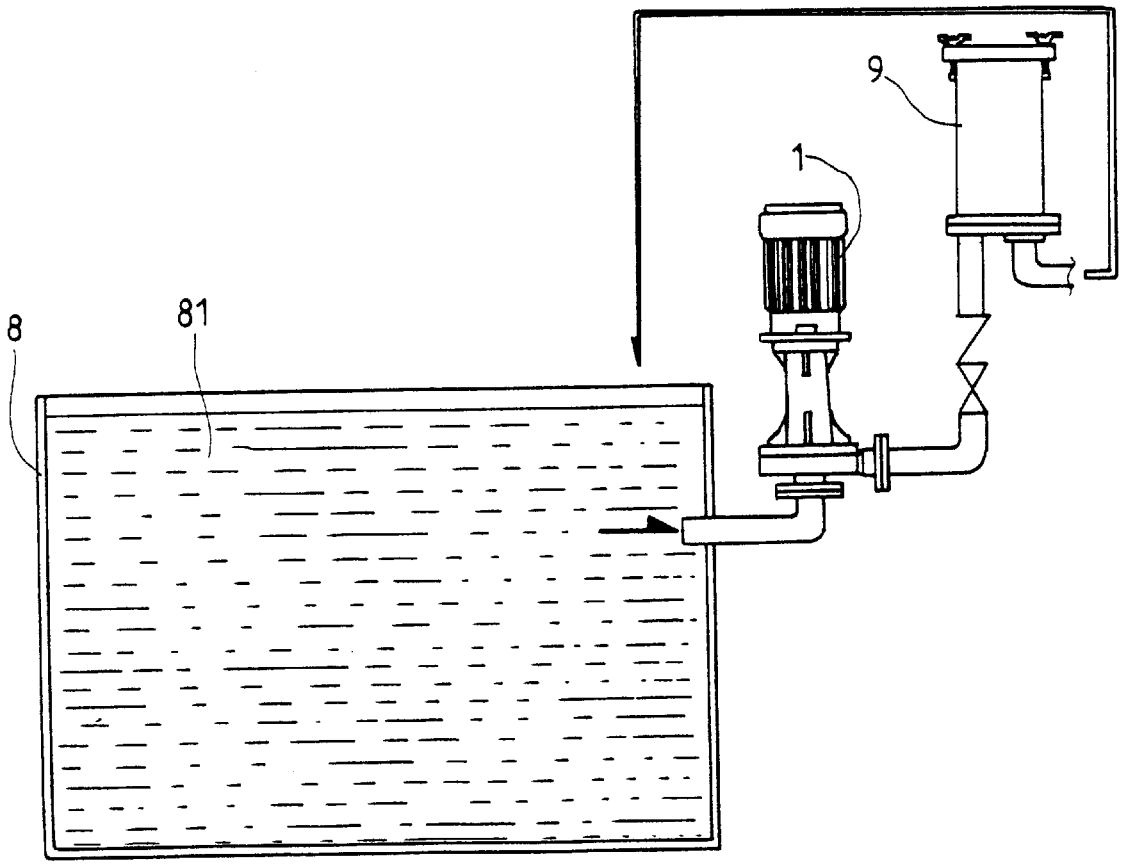
PRIOR ART FIG. 1
FIG. 1 is a schematic view showing the installation of the conventional pump.
Figure 2A:
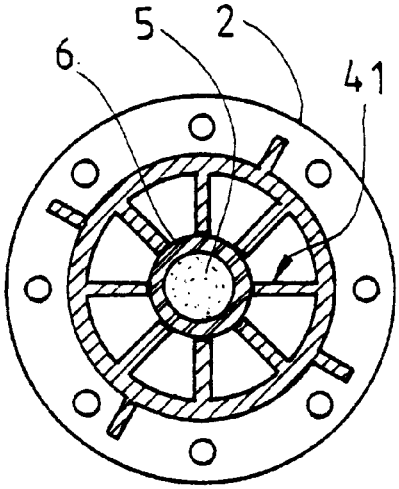
PRIOR ART FIG. 2A
FIG. 2A is a cross-sectional view along line A—A of FIG. 2.
Figure 2:
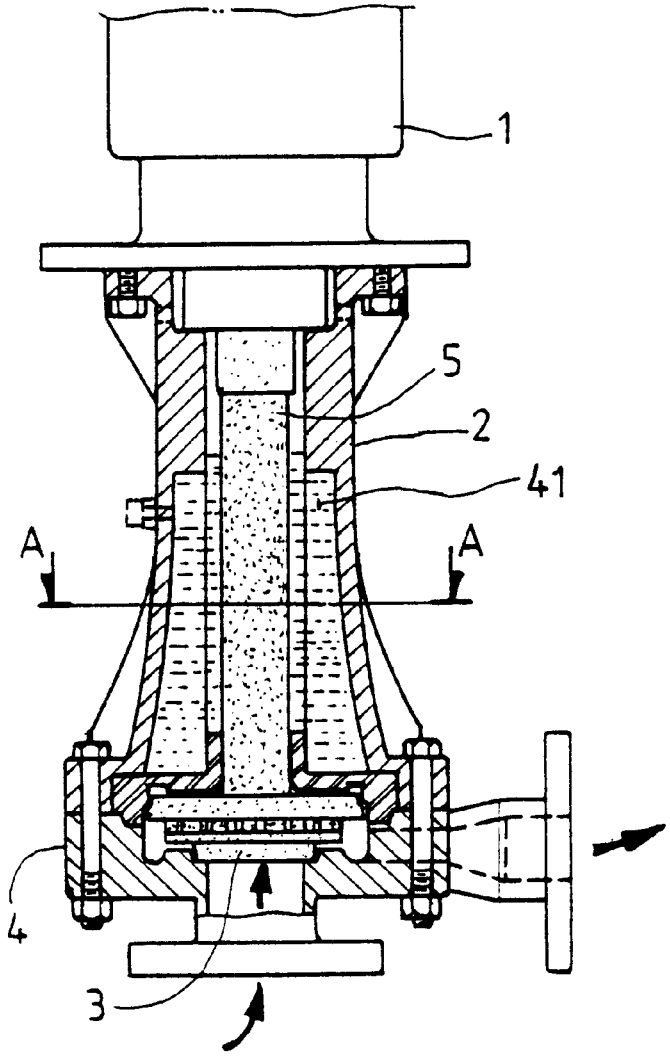
PRIOR ART FIG. 2
FIG. 2 is a sectional view of the conventional pump.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 3:
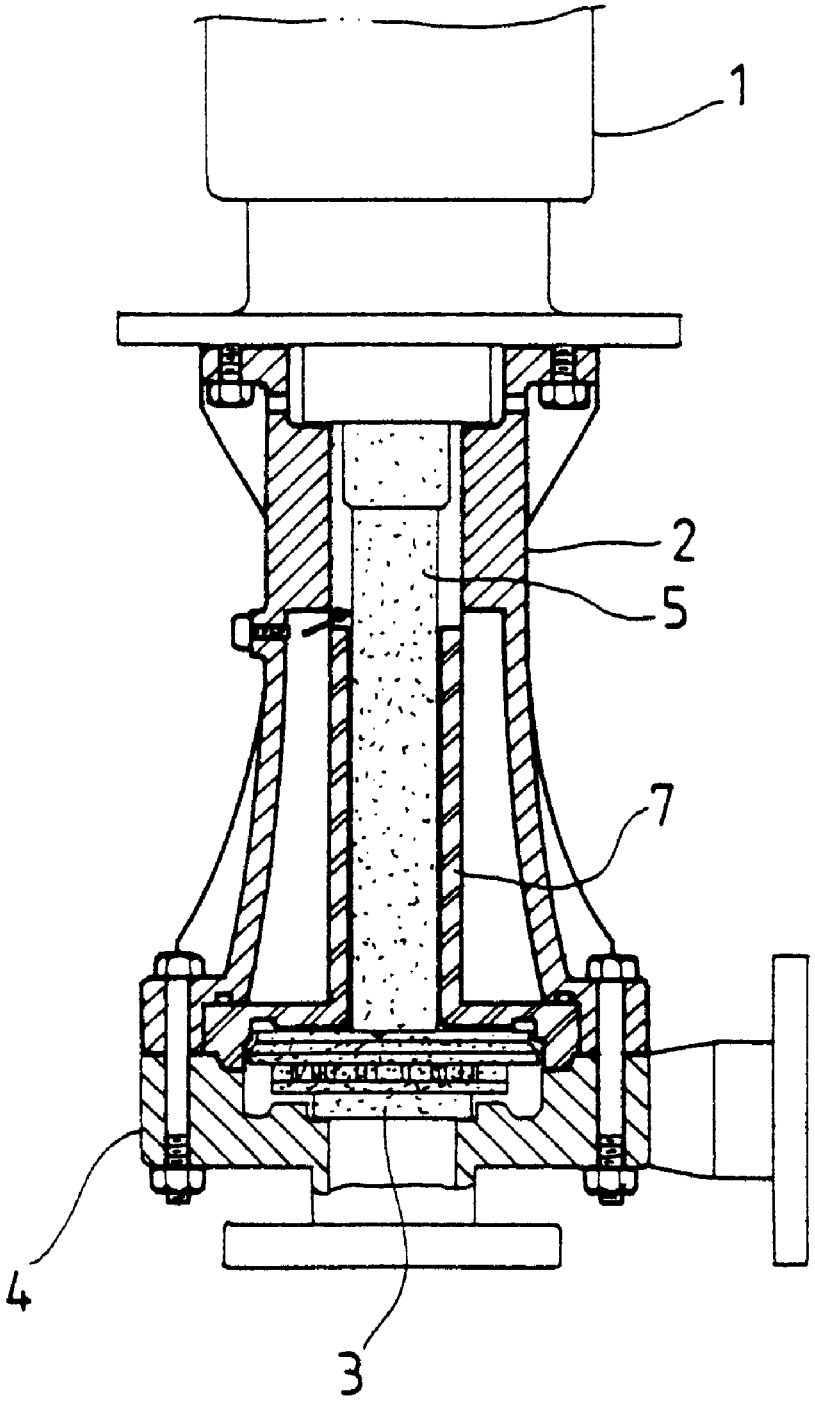
FIG. 3 is a sectional view of the pump in accordance with the present invention.
Figure 4:
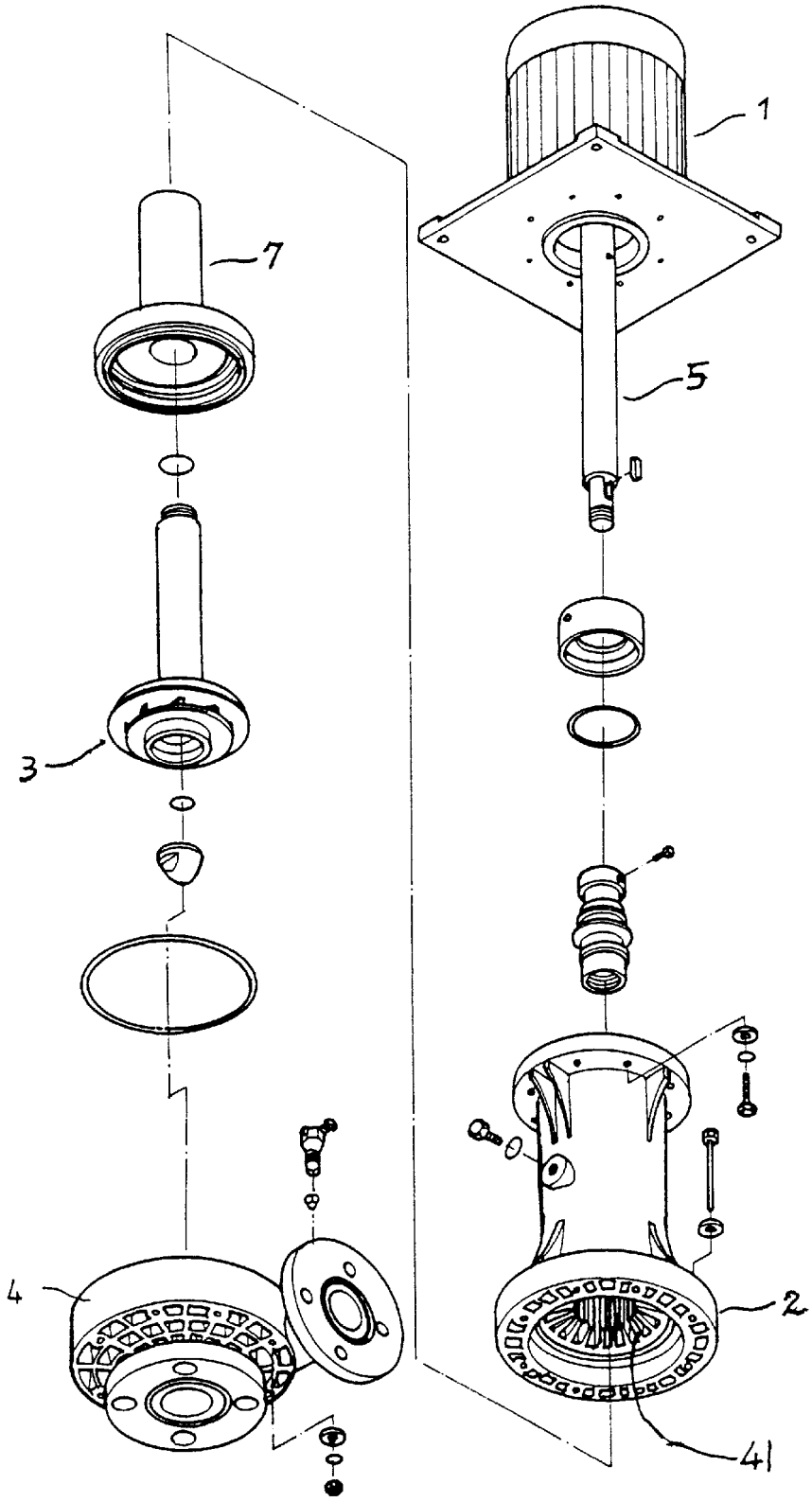
FIG. 4 is a perspective exploded view of the pump in accordance with the present invention.

Referring to FIGS. 3 and 4, there is shown an acid/base resistance pump comprising a motor 1, a body housing 2, a center cavity 7, an axle device 5, a blade device 3, and a water-transporting seat 4. The motor 1, which provides power to the pump, is located at the top section of the housing 2, and the water-transporting seat 4 is located at the bottom section of the housing 2. The axle device 5 for transmission is located within the water-transporting seat 4, and the front section of the water-transporting seat 4 is provided with the blade device 3 for flowing of solution 81. The center cavity 7 is located between the body housing 2 and the water-transporting seat 4, and the center cavity 7 is detachable and is only mounted within the body housing 2. The blade device 3 is located at the external side of the center cavity 7. In accordance with the present invention, the center cavity 7 encloses the axle device 5 and therefore, the solution 81 flowing from the water-transporting seat 4 via the blade device 3 is completely restricted outside the center cavity 7. Thus, the part of the present invention that contacts with the solution is minimized. When the parts of the pump are corroded by corrosive chemical solutions, they can be replaced and therefore, the cost of maintenance of the pump in accordance with the present invention is low, and the maintenance procedures are simple and convenient too.

Further, the center cavity 7 and the body housing 2 are separable, and at the same time, the center cavity 7 isolates the solution 81 to be positioned in between the water-transporting seat 4 and the blade device 3. In view of the above, the motor, which provides power to the pump, can be replaced with a more powerful one, and the center cavity 7 can be changed to comply with the requirements of the motor. Therefore, the manufacturer can manufacture pumps of various specifications to fulfill customer's requirements without exploiting new molds for the parts of the pump. In other words, these parts of the pumps can be used in other pumps with different motors.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of an acid/base resistance pump having a motor, a body housing, a center cavity, an axle device, a blade device and a water-transporting seat, the motor being mounted on the top of the housing and the center of the motor being the axle device for transmission, the front section of the axle device being connected with the motor and the blade device for fluid flowing being disposed at the other end of the center of the axle device, and the lower side of the housing being the water-transporting seat, characterized in that the center body is detachably mounted between the water-transporting seat and the body housing such that the blade device is located at the external side of the center cavity, and the center cavity isolates the solution at the position between the water-transporting seat and the blade device.

* * * * *